US005157758A

United States Patent [19]

Halberstadt et al.

[11] Patent Number: 5,157,758

[45] Date of Patent: Oct. 20, 1992

[54] TUNGSTEN HALOGEN LAMP

[75] Inventors: Alex L. Halberstadt, London; John A. Letchford, Middlesex, both of England

[73] Assignee: Thorn Emi plc, London, England

[21] Appl. No.: 611,654

[22] Filed: Nov. 13, 1990

[30] Foreign Application Priority Data

Nov. 18, 1989 [GB] United Kingdom ..... 8926139

[51] Int. Cl.[5] ..... H05B 3/10

[52] U.S. Cl. ..... 392/408; 392/407; 313/112; 313/579; 313/572; 313/634; 313/580; 219/553

[58] Field of Search ..... 313/579, 572, 112, 634, 313/569, 580; 219/461–464, 553; 392/407, 408

[56] References Cited

U.S. PATENT DOCUMENTS

| | | | |
|---|---|---|---|
| 2,864,025 | 12/1958 | Foote et al. | 313/279 |
| 2,918,595 | 12/1959 | Cressman . | |
| 3,258,631 | 6/1966 | Elmer . | |
| 4,426,570 | 1/1984 | Hikino et al. | 219/354 |
| 4,598,194 | 7/1986 | Halberstadt et al. | 219/464 |

FOREIGN PATENT DOCUMENTS

| | | |
|---|---|---|
| 0133764 | 3/1985 | European Pat. Off. . |
| 2818815 | 11/1979 | Fed. Rep. of Germany . |
| 1111556 | 3/1956 | France . |
| 272639 | 6/1927 | United Kingdom . |
| 2144956 | 3/1985 | United Kingdom . |

OTHER PUBLICATIONS

Soviet Inventions Illustrated, week 9011, Apr. 25, 1990, Derwent Publications Ltd., London, Great Britain. SU-A-1483 507 (Moscow Fine Chem.); May 30. 1989 *Abstract*.

*Primary Examiner*—Bruce A. Reynolds
*Assistant Examiner*—Michael D. Switzer
*Attorney, Agent, or Firm*—Jacobson, Price, Holman & Stern

[57] ABSTRACT

A tungsten halogen lamp producing infra red radiation, for example for cooking or heating, has an envelope of high silica content material sealed at each end by a pinch seal. A gas fill is at a room temperature pressure of 250–750 mm Hg. A portion of the envelope at each end is clear and the rest contains an opacifier which reduces transmission of visible light. A suitable opacifier is red, being produced by the reduction of copper oxide dispersed in the high silica content material. The envelope is produced by butt joining clear end sections and a tube of material containing opacifier.

2 Claims, 1 Drawing Sheet

TUNGSTEN HALOGEN LAMP

Figure 1:
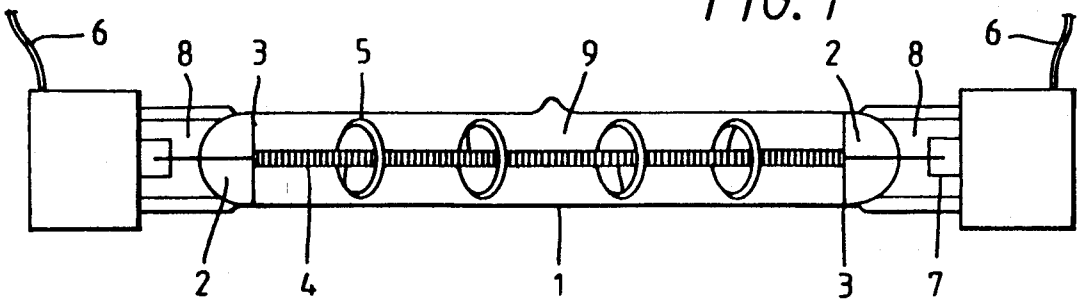

This invention relates to tungsten halogen lamps. In particular it relates to such lamps which produce a large amount of infrared radiation and which are used as the energy source in heaters of various types. In addition to space heaters and specialist applications such as paint drying etc. these lamps have found particular use in recent years, following the invention described in the applicants' European Patent No. 117346, in cooking hobs.

In addition to the infra-red radiation which is produced by such lamps, there is a fair amount of visible radiation and this can be on occasion objectionable to the user since, in the absence of means to alleviate it, it produces a degree of "glare". Numerous means have been adopted to prevent this glare whilst of course retaining the infrared transmission of the lamp and one of these is described in our UK application No. 2176587A. This specification discloses a tungsten halogen infrared lamp which is housed inside an outer jacket. Whilst this does provide a solution to the problem, it is an expensive one since, because of the high operating temperature of these lamps the outer jacket has to be fabricated from an expensive high silica material.

As stated in the above UK Patent Application 2176587A, it was not previously possible to produce a usable product by using a red coloured high silica material as the main envelope of the lamp since this material which is a very poor absorber of heat cannot be heated to a sufficient temperature either to produce a seal itself or to be joined consistently to a clear tube of material of the same glass which can be properly sealed.

It is an object of the present invention to produce an infra-red Tungsten Halogen lamp which has a practical working life (in excess of 2,000 hours) and wherein the amount of glare is greatly reduced, whilst at the same time, the effective infra-red radiation from the lamp is increased.

Accordingly we provide a long life tungsten halogen infrared lamp for use in heaters comprising an envelope of high silica content material sealed at each end by a pinch seal, a filament capable of operating at a temperature in the range of 2000° K. to 2600° K. and a gas fill, wherein the portion of the envelope adjacent each end is clear and the rest of the envelope contains an opacifier which reduces the transmission of visible light and wherein said gas fill is, at room temperature, at a pressure of from 250 to 750 mm Hg.

The said clear end portions of the envelope are joined to the envelope by means of a butt seal which is formed by heating the end of the opacified envelope to such a temperature that when butted against a clear tube of the same material and of similar diameter a seal is formed. Although previous attempts to form such a butt seal were not entirely successful in that the lamp, in operation, fractured at the butt seal after a rather short life, we have found that the use of the above-mentioned pressure of between 250 and 750 mm Hg as opposed to the conventional pressure which is around 1500 mm Hg, leads to an operating pressure considerably less than that previously used and under these conditions the butt seal is viable.

The use of such comparatively low, sub atmospheric, pressures, is generally thought to lead to reduced lifetimes in lamps used for normal lighting applications because of rapid evaporation of tungsten. However, surprisingly, it is found not to shorten the life of the lamps according to the present invention, since evaporation is reduced by the low efficiency.

The material from which the envelope of the lamp is formed is a high silica material such as quartz or Vycor (Registered Trade Mark). Other high temperature glasses such as aluminosilicate or borosilicate (Pyrex-Registered Trade Mark) can be used but are less preferable since they are less efficient transmitters of infrared radiation.

Suitable opacifiers are those which provide a red or ruby colour i.e. a "warm" effect. A particularly suitable material is that which is produced by subjecting a tube of quartz containing copper oxide to a diffusion process in an atmosphere of hydrogen when the copper oxide is reduced to metallic copper. It is believed that the opacifier actually enhances the infra-red transmission through the lamp envelope. This is a standard product available from glass manufacturers. The density of the ruby colouring is a function of the firing time used by the glass manufacturer and can be chosen as required.

The lamps according to this invention have very greatly reduced glare of over 30% and, at the same time, the infra-red transmission is increased by from 5% to 7%.

The envelopes of the lamps according to this invention may be formed in a very small diameter for example between 7 and 12 mm, preferably around 10 mm. This gives a significant advantage of cheapness over conventional quartz lamps which normally have an external diameter rather larger than this and of course a great advantage over the jacketed lamp described in British Patent Application 2176587 where the external diameter is in excess of 20 mm.

As mentioned in the introduction, the lamps of this invention may be used in heaters and are particularly suitable for use in cook-tops of the type described in our European Patent 117346.

In such cook-tops, it is normally necessary to position the tungsten halogen infrared lamp beneath a ceramic top which, in order to reduce the glare is made of an opacified ceramic glass. Such ceramic glass is very expensive and, using the lamps of the present invention, it is possible either to use clear ceramic or very lightly opacified ceramic glass or to use a clear ceramic such as Robax (Registered Trade Mark) on which has been deposited a very thin layer of a coloured ceramic or a ceramic paint. This thin layer of ceramic paint can be part of the decoration of the cook top. The reduced glare makes it unnecessary to frost the ruby/red lamp to disperse the light as has been necessary hitherto when using clear quartz.

Figure 2:
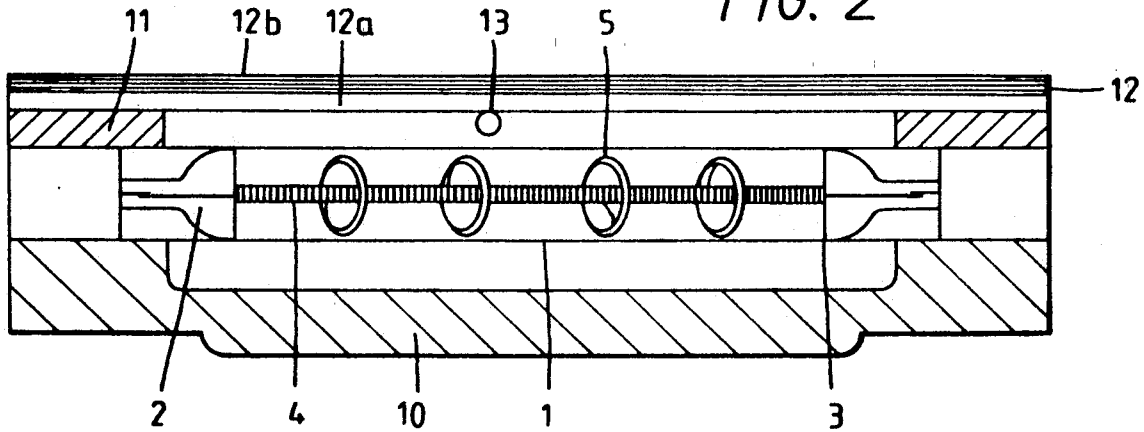

A specific embodiment of the invention will now be described with reference to the accompanying drawings wherein FIG. 1 illustrates a lamp according to the present invention and FIG. 2 shows a cross section of a cook-top incorporating a lamp of the present invention.

In FIG. 1 a tungsten halogen infrared lamp comprises a quartz tube which is formed of a main portion 1 and end portions 2, these portions being joined by butt seals shown at 3. The main portion of the envelope at 1 is of quartz glass which has been treated to have a ruby colour by the incorporation therein of a pigment formed by the hydrogen diffusion treatment of a copper oxide material. The butt seal 3 is formed by heating the ends of the pigmented tube 1 a very high temperature (about 1800° K.), and then abuting to it clear quartz portions 2. After the incorporation of the filament 4 which is supported in the conventional manner by spaced helical supports 5 and electrically connected to the power supply 6 by means of a sealing foil 7, the pinch seal 8 is formed at each end in the clear quartz. The gas and halogen fill 9 (argon plus a trace of hydrogen bromide) is then injected at a pressure of approximately 400 mm Hg.

In operation it is found that the lamp has an operative life well in excess of 2,000 hours. In spite of the low fill pressure provided the halogen content is properly adjusted in a manner well known to those familiar with the manufacture of tungsten halogen lamps there is no blackening which might otherwise be caused by evaporated tungsten used in a tube which was operated at this pressure for this duration of life.

In FIG. 2 there is shown a cook-top incorporating a lamp according to the present invention the reference numerals used in relation to the lamp having the same significance as those in FIG. 1. The lamp is mounted, normally together with one, two or three other such lamps on a dished flan, normally supported on a metal support (not shown) which dished flan is filled with from a microporous material such as "Microtherm". Further insulating ring supports 11 space the lamp from the ceramic top plate 12 on which cooking utensils are placed. A thermal limiter 13 is normally incorporated in the arrangement.

In the specific embodiment shown the ceramic top plate is in two layers 12*a* and 12*b*, 12*a* being of a clear glass ceramic such as Robax (Registered Trade Mark) and 12*b* being an applied ceramic coating formed from a high temperature and light transmitting paint.

We claim:

1. A tungsten halogen infra red lamp for use in a heater, the lamp comprising:

an envelope of high silica content sealed at each end by a pinch seal, a portion of the envelope containing an opacifier which reduces the transmission of visible light, said portion being joined to each sealed end by respective butt seals;

a filament supported within the envelope capable of operating at a temperature in the range of 2000° K.; and a gas fill injected into the envelope at a pressure of from 250 to 750 mm Hg at room temperature.

2. A lamp according to claim 1 wherein the external diameter of the said envelope is between 7 mm and 12 mm.

* * * * *